United States Patent [19]

Clamage

[11] 4,217,982

[45] Aug. 19, 1980

[54] DISPLAY PACKAGE FOR FOLIAGE

[76] Inventor: Herbert M. Clamage, 9627 Kildare, Skokie, Ill. 60076

[21] Appl. No.: 948,913

[22] Filed: Oct. 5, 1978

[51] Int. Cl.[2] ..... B65D 85/52; A01G 5/00

[52] U.S. Cl. ..... 206/45.33; 47/84; 206/423; 206/497

[58] Field of Search ..... 206/45.14, 45.19, 45.33, 206/292, 297, 299, 423, 443, 466, 471, 476, 491, 495, 497; 229/40, 87 P, 87.5; 47/84

[56] References Cited

U.S. PATENT DOCUMENTS

| | | | |
|---|---|---|---|
| 2,911,093 | 11/1959 | Burton | 206/297 X |
| 2,923,401 | 2/1960 | Hagar | 206/45.33 UX |
| 2,932,384 | 4/1960 | Johnnides | 206/45.33 |
| 3,011,689 | 12/1961 | Korn et al. | 206/45.33 X |
| 3,104,011 | 9/1963 | Bowman | 206/45.33 |
| 3,298,506 | 1/1967 | Reiner et al. | 206/45.33 |
| 4,014,134 | 3/1977 | Womack, Jr. | 47/84 |
| 4,029,822 | 6/1977 | Lomer | 206/497 X |

FOREIGN PATENT DOCUMENTS

| | | | |
|---|---|---|---|
| 569503 | 1/1959 | Canada | 47/84 |
| 481693 | 1/1917 | France | 206/423 |
| 2366182 | 9/1976 | France | 206/423 |

*Primary Examiner*—Stephen Marcus

*Attorney, Agent, or Firm*—Silverman, Cass & Singer, Ltd.

[57] ABSTRACT

A display package for foliage such as ferns or the like having stripped free ends bundled and arranged together, a planar corrugated board having a return bent formation along one edge defining a pocket, said foliage being laid upon said board with said free ends terminating within said pocket and a plastic sheeting sealingly applied to said board and foliage fully encapsulating same whereby the free ends are prevented from puncturing the plastic sheeting should shifting occur during shipment or display.

5 Claims, 5 Drawing Figures

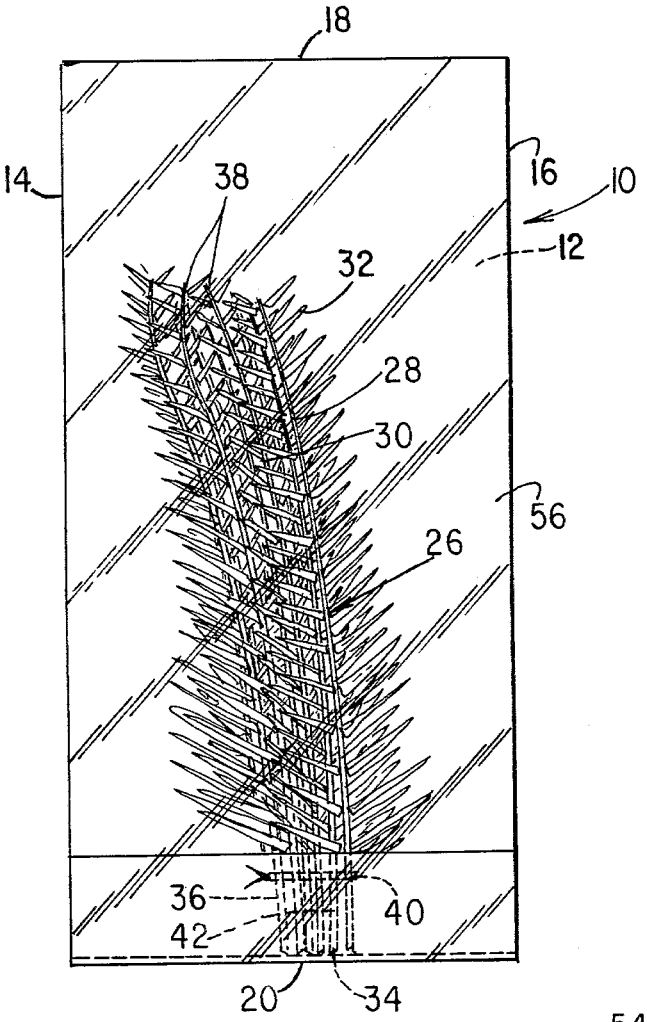
FIG 2
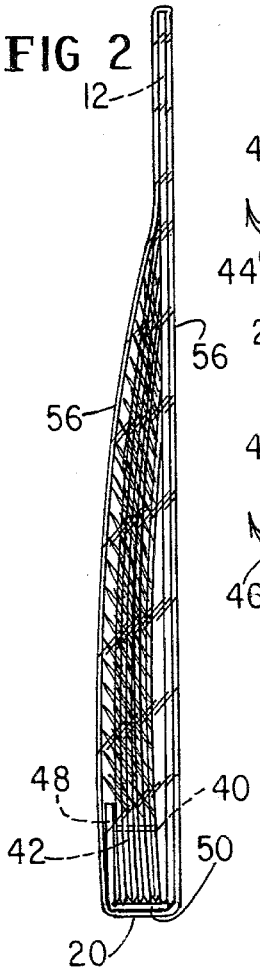
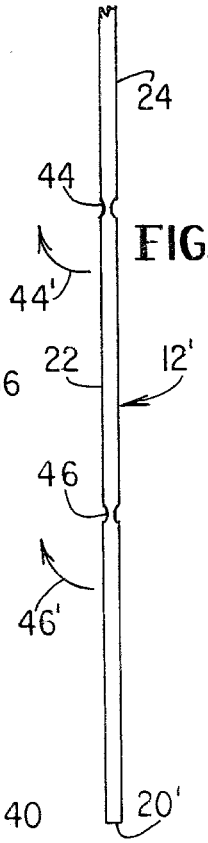
FIG. 4
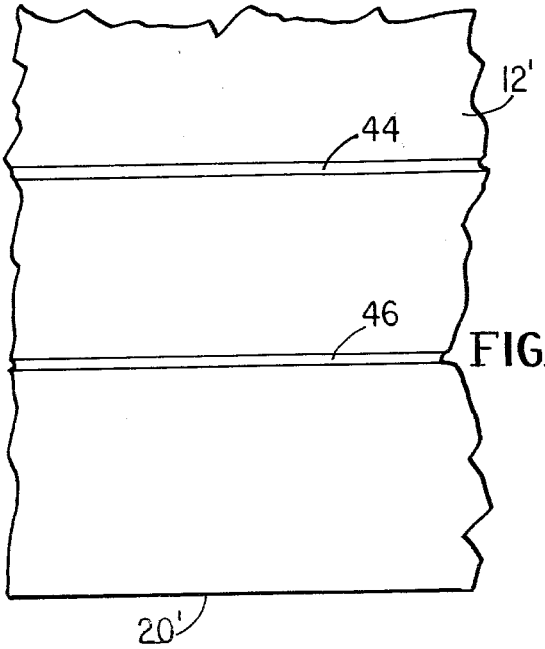
FIG. 3
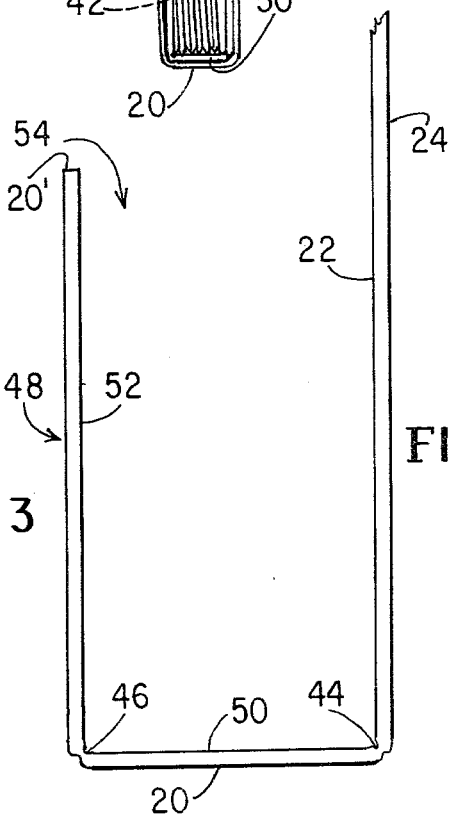
FIG. 5

DISPLAY PACKAGE FOR FOLIAGE

BACKGROUND OF THE INVENTION

This invention relates to display packages for the shipment and point of sale display of foliage branches such as ferns, and more particularly provides a display package for such goods which prevents damage to the package and/or goods occasioned by puncturing of the plastic wrap used to encapsulate same during shipment and/or point of sale display.

Foliage of the type concerned herein comprises ferns, palm fronds, cedar and the like, branches both natural and artificial, preserved or fresh, which are packaged and sold for decorative use by florists, decorators or the like. The branches may be sold and shipped in commerce in bulk containers, but more desirably are sold in small lots for point of sale display arranged on corrugated board or the like and wrapped in plastic sheeting, say by so-called "skin packaging" techniques or the like. There are particular problems arising out of the packaging of such materials, especially where point of sale displays are desired.

The skin packaging process involves the steps of tightly applying a plastic wrap stretchably about the goods arranged in a bundle but generally flat upon the board, and sealing the goods and board subsequent to wrapping by sealing the plastic sheeting such as sealing the edge around the same. The wrap may be slightly softened prior to the wrapping process and/or may be stretched slightly so that the goods are held fast to the board and are not supposed to be able to shift thereon during handling. In practice, this expedient has not been found to be sufficient to prevent shifting of the goods along the board.

Since the packages are intended for point of sale display, the wrap is required to be transparent. Further, for cost purposes, there is a limit to the thickness of the web of the wrapping material applied, relatively thin wrap being required. The foliage may shrink slightly, air may be entrapped between the branches thereof, the board may be deformed slightly during handling, i.e., such as flexed, for example. The wrap may stretch. All contribute to the likelihood of shifting of the goods along the board.

As mentioned above, the foliage branches have stem ends which are leaf free, and terminate in somewhat sharp ends, the same being broken off when removed from the natural flora. Those ends may not puncture the plastic wrap if only a few pieces were packaged but, since say 50 or 60 or more pieces are packaged, especially with their ends juxtaposed and bundled, their bulk weight is of substance. When the mass slides along the board, the force that is exerted on the wrap, especially upon the weakest portion thereof along the narrow edge of the package adjacent to said ends, is sufficient of puncture the wrap. With the packages standing upright, the danger increases. When said puncture of the wrap occurs, the ends of the bundled foliage fall from the end of the package, resulting in loss and/or damage to the foliage and causing same to be rendered defective for use and causing same to be returned to the manufacturer. The perishable items lose moisture and become frangible. The ends break off. The leaves dry out. Substantial monetary loss is suffered by the seller since not only are the goods rendered defective, but the seller must pay the costs of shipping and replacement and in addition, will suffer the loss of valuable good will.

Weight is a factor in computing shipping costs and hence minimum packaging weight is an essential feature which must be considered in contemplating remedial action to ameliorate the puncture problem discussed above. Likewise, as mentioned, cost and weight dictate the thickness and type of plastic wrap which may be used to encapsulate the board and goods.

Accordingly, it would be highly advantageous to provide a simple inexpensive and effective solution to the problems described above, said solution not requiring complications in the packaging or shipment.

SUMMARY OF THE INVENTION

Display package for foliage such as ferns and the like having free stem ends, said package comprising a substantially planar board, a plurality of said foliage branches arranged juxtaposed on the board, a return bent end formation along one edge of said board and integral therewith, the free stem ends disposed terminating within said end formation and plastic sheeting sealably applied to and surrounding both said board and the foliage arranged thereupon, encapsulating same.

BRIEF DESCRIPTION OF THE DRAWING

FIG. 1 is a plan view of the display package of the invention;

FIG. 2 is a side elevational view of the package of FIG. 1;

FIG. 3 is a fragmentary plan view of the board blank used to form the package of FIG. 1;

FIG. 4 is a fragmentary enlarged side elevational view of the board blank before folding; and FIG. 5 is a fragmentary enlarged side elevational view of the board blank after folding to form the lip formation according to the invention.

DESCRIPTION OF A PREFERRED EMBODIMENT

The display package embodying the invention is illustrated in FIGS. 1 and 2 and represented by reference character 10. The package 10 comprises a board 12 of corrugated paper board material of rectangular planar conformation. The board 12 has a pair of parallel sides 14 and 16 and a pair of ends 18 and 20. Top and bottom surfaces 22,24 are provided, each capable of carrying printed indicia thereupon.

The goods which are packaged comprise a plurality 26 of foliage pieces, each herein comprising a fern branch 28 having a stem 30 and a plurality of leaves 32 of increasing length along said stem 30 and extending progressively outwardly therefrom in order of gradually increasing length to a maximum and then of progressively decreasing length to a location spaced from the terminal portion 34 so as to leave leaf-free stem ends 36. The terminal portion 34 of ends 36 generally is rough and somewhat sharp due to the manner by which the branch 28 is removed from the plant in harvesting same. The leaves 30 of the fern branches generally occupy a single plane with some curl along the edges of the branches 28 and along the stems 30.

The branches 28 are laid juxtaposed one upon the others, generally 50 or so, to form the pile or plurality 26 to be packaged. The plurality 26 is disposed upon board 12 with the tips 38 and ends 36 facing ends 18 and 20 respectively. The free ends 34 are arranged grouped and tied at 40 to define a bundle 42.

The planar board 12 is provided as a blank 12' with a pair of parallel fold lines 44 and 46 along one surface 22 of board 12. The pair of lines 44 and 46 are transverse the board 12 parallel to the end 20 thereof and are spaced a predetermined distance therefrom.

Prior to placement of the plurality 26 of branches 28 upon the blank board 12', or after such placement, the board 12' is bent at the fold line 44 at a 90 degree angle (see arrow 44') and also is bent at the fold line 46 (see arrow 46'), also at a 90 degree angle to define return bent formation 48 including panel 50 and return directed free end flange 52. The ends 36 of the plurality 26 of branches 24 are placed within the pocket 54 defined between the surface 22 of resulting board 12 and the flange 52.

The board 12 and the branches 28 arranged thereupon as described then are placed in a conventional packaging machine such as a "skin-packaging" or wrapping machine (not shown) where a sheet of flexible plastic film 56 is wrapped about the branches 28 and board 12 with the ends 28 within the pocket. The plastic film 56 is drawn tightly about the board 12 and foliage branches 28 and hermetically sealed, encapsulating said board and foliage.

Now, if for any reason the foliage branches 28 slide upon the board, the protection afforded by the return bent formation prevents the ends 28 from breaking through the plastic sheeting as during handling, shipment, transport and/or display, say at point of sale stands whereat the packages are arranged generally vertically oriented. In shipment, the packages are laid one on the other, and friction may cause shifting.

The flange 52 may be formed of varying length to provide a surface which would be a continuation of the undersurface 24 of board 12. This surface area is advantageous in that it is viewable from the front of the package and can accommodate printed indicia detailing advertising, instructions for use and other commercial information as may be desired.

The invention is not intended to be limited to accommodation of foliage branch pieces stacked one upon the other in juxtaposed condition but is equally applicable to display of different array arrangements, such as staggered or stepped arrays (not shown). Minor variations of size, configuration, etc. may be accommodated within the scope of the invention as defined by the appended claims hereto.

What I claim is:

1. A display package for foliage such as ferns or the like having stem ends arranged grouped together, said package comprising a planar board, a plurality of foliage branches arranged grouped on the board, a return bent transverse lip formation along one end of said board and unitary therewith defining a pocket having open sides and a closed end, the free stem ends disposed terminating within said pocket and plastic sheeting shrinkably applied sealably to and surrounding said board and foliage arranged thereupon totally encapsulating said board and foliage sealed from the exterior of said package, and puncture of the plastic sheeting by said stem ends being prevented by said closed end.

2. A display package as claimed in claim 1 in which said branches are disposed with portions juxtaposed.

3. The display package as claimed in claim 1 in which said board is formed of a unitary blank having a pair of spaced transverse parallel folds formed thereon upon one surface thereof, said blank being return bent along said folds to define said lip formation.

4. The display package as claimed in claim 1 in which said board is formed of a unitary blank having a pair of spaced transverse parallel folds formed thereon upon one surface thereof, said blank being return bent along said folds to define said lip formation, said branches being placed one atop the others with their free ends closely adjacent each other and tie means holding said free ends together.

5. The display package as claimed in claim 1 in which said board is formed of a unitary blank having a pair of spaced transverse parallel folds formed thereon upon one surface thereof, said blank being return bent along said folds to define said lip formation, and the distance between fold lines being less than the distance of said end of the board to the fold line next adjacent thereto.

* * * * *